US010245488B1

(12) United States Patent
Kays et al.

(10) Patent No.: US 10,245,488 B1
(45) Date of Patent: Apr. 2, 2019

(54) VIBRATION DAMPING BAT AND METHODS OF MAKING THE SAME

(71) Applicant: MIZUNO CORPORATION, Chuo-Ku, Osaka-shi (JP)

(72) Inventors: Brendan Kays, Norcross, GA (US); Yohei Yamashita, Norcross, GA (US); David Llewellyn, Norcross, GA (US)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 15/798,857

(22) Filed: Oct. 31, 2017

(51) Int. Cl.

| | |
|---|---|
| ***A63B 59/00*** | (2015.01) |
| ***A63B 60/54*** | (2015.01) |
| ***A63B 59/50*** | (2015.01) |
| ***A63B 59/51*** | (2015.01) |
| *A63B 102/18* | (2015.01) |

(52) U.S. Cl.
CPC ..... *A63B 60/54* (2015.10); *A63B 59/50* (2015.10); *A63B 59/51* (2015.10); *A63B 2102/18* (2015.10); *A63B 2102/182* (2015.10); *A63B 2209/00* (2013.01)

(58) Field of Classification Search
CPC ..... A63B 59/50; A63B 59/51; A63B 59/52; A63B 60/54; A63B 2102/18; A63B 2102/182; A63B 2209/00
See application file for complete search history.

(56) References Cited

U.S. PATENT DOCUMENTS

| | | | | |
|---|---|---|---|---|
| 4,951,948 | A * | 8/1990 | Peng | A63B 59/50 473/520 |
| 5,964,673 | A * | 10/1999 | MacKay, Jr. | A63B 59/51 473/566 |
| 7,201,679 | B2 * | 4/2007 | Nguyen | A63B 59/59 473/520 |
| 7,798,926 | B1 * | 9/2010 | Hsu | A63B 59/51 473/566 |
| 8,226,505 | B2 * | 7/2012 | Burger | A63B 60/10 473/520 |
| 9,067,109 | B2 | 6/2015 | Epling et al. | |
| 9,242,156 | B2 | 1/2016 | Goodwin et al. | |
| 2004/0209716 | A1 * | 10/2004 | Vacek | A63B 59/54 473/567 |
| 2005/0143203 | A1 * | 6/2005 | Souders | A63B 59/51 473/564 |
| 2006/0252586 | A1 * | 11/2006 | Nguyen | A63B 59/59 473/564 |

(Continued)

*Primary Examiner* — Raleigh W Chiu
(74) *Attorney, Agent, or Firm* — Troutman Sanders LLP; Daniel Sharpe

(57) ABSTRACT

A softball or baseball bat is provided. The bat can comprise a handle that has a proximate end and a distal end and a barrel that has a hollow portion. The bat can comprise first damping section that comprises a first material, and the first damping section can be at least partially interposed between a portion of the handle and a portion of an inner wall of the barrel. The bat can comprise a second damping section that can comprise a second material, and the second damping section can be at least partially interposed between a portion of the handle and a portion of the inner wall of the barrel. At least a portion of the first damping section or the second damping section can prevent the handle from directly contacting the barrel when the bat is at rest.

20 Claims, 3 Drawing Sheets

(56) References Cited

U.S. PATENT DOCUMENTS

| | | | | |
|---|---|---|---|---|
| 2007/0155546 | A1* | 7/2007 | Chauvin | A63B 59/00 473/520 |
| 2007/0191156 | A1* | 8/2007 | Van Nguyen | A63B 59/51 473/564 |
| 2008/0058132 | A1* | 3/2008 | Nguyen | A63B 59/50 473/564 |
| 2011/0098141 | A1* | 4/2011 | Burger | A63B 59/50 473/520 |
| 2011/0111892 | A1* | 5/2011 | Thouin | A63B 60/10 473/520 |
| 2015/0273295 | A1* | 10/2015 | Haas | A63B 60/06 473/520 |
| 2016/0158613 | A1* | 6/2016 | Burger | A63B 59/50 473/564 |
| 2016/0184680 | A1* | 6/2016 | Van Nguyen | A63B 60/54 473/520 |
| 2017/0165549 | A1* | 6/2017 | Stenzler | G06Q 30/0621 |
| 2017/0354854 | A1* | 12/2017 | Lanyon | A63B 59/50 |
| 2018/0015342 | A1* | 1/2018 | Van Nguyen | A63B 59/54 |
| 2018/0065011 | A1* | 3/2018 | Earley | A63B 60/42 |

* cited by examiner

--PRIOR ART--

--PRIOR ART--

VIBRATION DAMPING BAT AND METHODS OF MAKING THE SAME

BACKGROUND OF THE INVENTION

1. Field of the Invention

The present invention relates generally to bats for use in baseball and softball and specifically to bats with shock-absorbing capabilities.

2. Background of Related Art

Conventionally, bat manufacturers have endeavored to improve the performance of bats. In the case of a bat, improved performance can come in the form of, among other things, improved accuracy, reduced vibration, or increased coefficient of restitution. Vibration at impact between a bat and ball can generally be reduced by striking the ball with the bat's "sweet spot" or center of repercussion. However, a ball struck on either side of the bat's sweet spot (e.g., between the sweet spot and the cap or between the sweet spot and the handle) may cause vibrations to transmit through the bat and into the user's hands. For example, striking a ball between the sweet spot and the handle can cause a bat to bend or deform, as shown in panels (a) and (b) of FIG. 1A, and striking a ball between the sweet spot and the cap can cause a bat to bend or deform, as shown in panels (a) and (b) of FIG. 1B. The bending or deformation may result in vibrations that may create an unpleasant or painful sensation for the user and/or may injure the user's psyche, which may inhibit the user's performance during use of the bat. The discomfort or pain may be particularly prevalent among children or aged users.

Typically, a bat has a first flexural bending mode and a second flexural bending mode. The first mode generally has a natural frequency of approximately 150 Hz to approximately 200 Hz and, generally, has a bending node approximately 6 inches from the knob (i.e., the end of the bat nearest the handle). This typically results in a low amount of vibration at the bending node of the first flexural bending mode (i.e., 6 inches from the knob) but also typically results in a high amount of deflection (i.e., vibration) at the knob, which is where a user's lower hand is typically positioned. The second flexural bending mode generally has a natural frequency of approximately 600 Hz, and generally has a bending node approximately 2 inches from the knob. Thus, while there may be little to no vibration at or near the knob, a high amount of vibration may be felt where a user's upper hand is typically located.

Conventional bats include only a single vibration isolator such that vibration is reduced for only one of the bending modes. Some bats may use high damping materials to absorb shock. High damping materials may limit the transmission of vibrations at frequencies lower than the natural frequency but may allow more vibration above the natural frequency. Other bats may use low damping materials. Low damping materials may better limit vibration at frequencies above the natural frequency but tend to transmit more vibration at the natural frequency.

An example of a bat design aiming to absorb vibration is U.S. Pat. No. 5,593,158 to Filice et al. This bat comprises a single elastomeric isolation union element between a separately manufactured handle and barrel. An elastomer is used to dampen vibration but is only capable of damping a single mode.

Another bat design aiming to reduce vibration comprises a weighted plug inserted in the handle at the knob, such as that of U.S. Pat. No. 6,743,127. This bat, however, aims to dampen the amplitude of vibration after the vibration has already traveled past and through a user's hands. Further, this bat is only capable of damping a single mode.

Yet another bat design aiming to reduce vibration is shown in U.S. Patent Pub. No. 2015/0273295 to Haas et al., which describes a joint connecting a handle and a barrel. The joint comprises a collar and a spacer that separates the collar from the distal end of the handle. The joint is used to dampen vibration but again is only capable of damping a single mode.

Thus, existing designs aim to dampen vibration transmitted to the user, but to do so, these designs permit relative motion between the barrel and the handle. This can create energy losses, which may negatively impact a user's performance with the bat.

What is needed, therefore, is a bat designed to absorb shock and limit the transmission of vibration to a user's hands without decreasing energy transfer from the bat to the ball.

SUMMARY OF THE INVENTION

Embodiments of the present invention relate to bats having shock-absorbing or vibration damping properties without incurring significant energy losses. According to some embodiments, a bat can comprise a handle having a proximate end and a distal end and a barrel having a hollow portion. The bat can also include a first damping section and a second damping section. The first damping section can be at least partially interposed between a portion of the handle and a portion of an inner wall of the barrel, and the second damping section can be at least partially interposed between a portion of the handle and a portion of the inner wall of the barrel. The first damping section can be located nearer the distal end of the handle than the proximate end of the handle, the second damping section can be located nearer the proximate end of the handle than the first damping section, and at least a portion of the first damping section or at least a portion of the second damping section can prevent the handle from directly contacting the barrel when the bat is at rest.

According to some embodiments, a bat can comprise a handle having a proximate end and a distal end and a barrel having a hollow portion and an inner wall. The inner wall of the barrel can comprise a groove ring traversing a circumference of the inner wall. The bat can comprise a first damping section comprising rubber having a Shore hardness of approximately 70A to approximately 100A, and the first damping section can comprise a protrusion ring traversing a circumference of an outer surface of the first damping section. The first damping section can be interposed between a portion of the handle and a portion of the inner wall of the barrel, and at least a portion of the protrusion ring can be inserted into at least a portion of the groove ring. The bat can comprise a second damping section comprising silicone having a Shore hardness of approximately 20A to approximately 40A, and the second damping section can have a first portion interposed between a portion of the handle and a portion of the inner wall of the barrel and a second portion extending out of the hollow portion of the barrel. The bat can also comprise a gap between a proximate edge of the first damping section and a distal edge of the second damping section, and at least a portion of the first damping section or at least a portion of the second damping section can prevent the handle from directly contacting the barrel when the bat is at rest.

According to some embodiments, a method of manufacturing a bat is provided. The method can comprise providing a handle that can have a proximate end and a distal end, providing a barrel that can have a hollow portion and an inner wall, and providing a first damping section that can comprise a first material. The method can also comprise attaching the first damping section to the handle nearer the distal end of the handle than the proximate end of the handle. The method can also comprise providing a second damping section that can comprise a second material, and attaching the second damping section to the handle nearer a proximate end of the handle than the first damping section. The method can also comprise inserting the handle, the first damping section, and at least a portion of the second damping section into the hollow portion of a barrel such that the first damping section is at least partially interposed between a portion of the handle and a portion of the inner wall of the barrel, such that the second damping section is at least partially interposed between a portion of the handle and a portion of the inner wall of the wall, and such that at least a portion of the first damping section or at least a portion of the second damping section prevents the handle from directly contacting the barrel.

BRIEF DESCRIPTION OF THE FIGURES

Reference will now be made to the accompanying figures, which are not necessarily drawn to scale, and wherein.

DETAILED DESCRIPTION OF THE INVENTION

To simplify and clarify explanation, systems and methods are described below, generally, as a bat with a shock-absorbing or vibration damping portion a method of making such a bat. One skilled in the art will recognize, however, that the invention is not so limited. The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention. The methods described herein are also intended to be illustrative and not restrictive, as the scope of the invention covers several suitable methods and processes of manufacturing a bat.

Figure 1A:
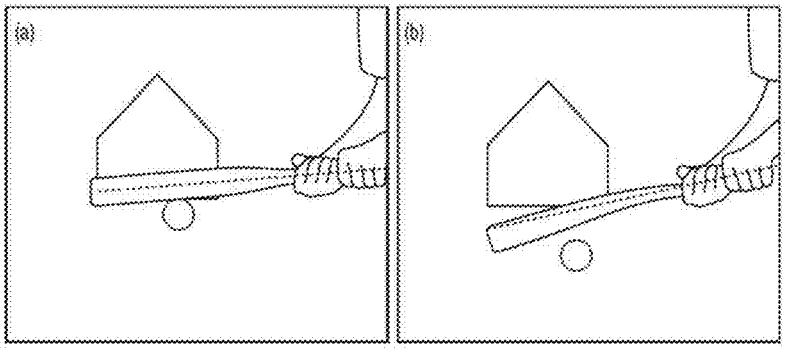
FIG. 1A depicts a conventional bat bending or deforming upon striking a ball between the sweet spot and the handle.
Figure 1B:
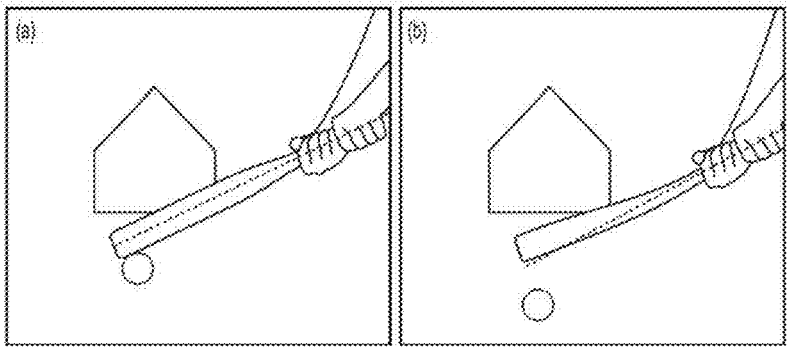
FIG. 1B depicts a convention bat bending or deforming upon striking a ball between the sweet spot and the cap.
Figure 2:
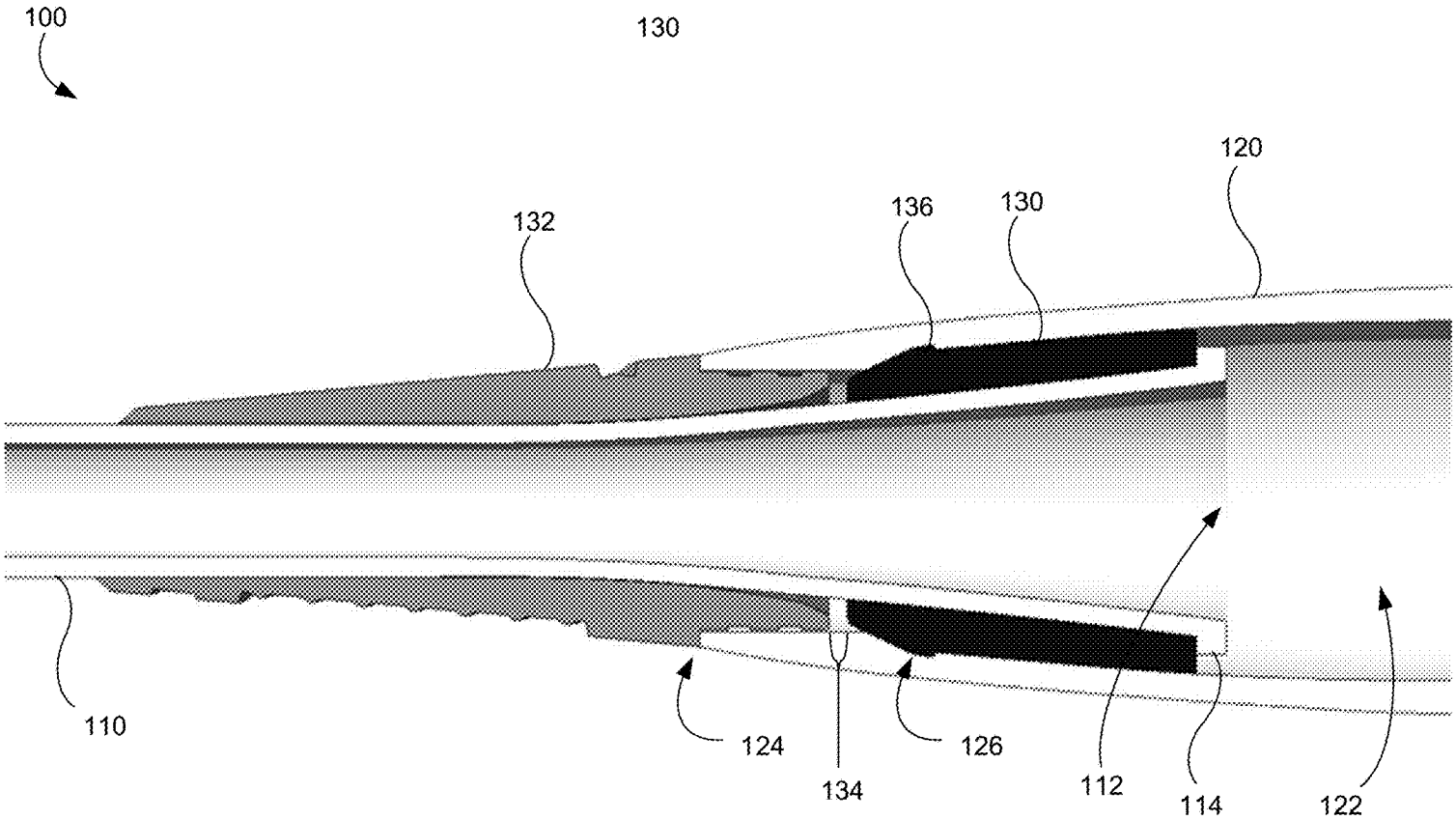
FIG. 2 depicts a partial cross-section view of a vibration damping bat, according to some embodiments of the disclosed technology.

Referring to FIG. 2, according to some embodiments of the disclosed technology, a bat 100 can include a handle 110, a barrel 120, a first damping section 130 that is at least partially interposed between the handle 110 and the barrel 120, and a second damping section that is at least partially interposed between the handle 110 and the barrel 120. In some embodiments, the handle 110 can have a knob (not shown) at a proximate end of the handle. In some embodiments, the diameter of the handle 110 may be substantially constant along the length of the handle 110. In certain embodiments, the handle 110 may have a diameter at or near the knob that is less than the diameter of the distal end 112 (i.e., the end of the handle 110 opposite the knob). In some embodiments, the diameter of the handle 110 may gradually increase to the distal end 112 of the handle 110. In some embodiments, the handle 110 can include a grip portion (not shown). In certain embodiments, the diameter of the handle 110 may begin to increase at a point between the grip portion and the distal end 112. In certain embodiments, the handle 110 can include a lip 114 at the distal end 112 of the handle 110. In some embodiments, the lip 114 may extend radially outward from the handle 110. In certain embodiments, the lip 114 may be a separate piece attached to the handle 110, while in other embodiments, the lip 114 may be integral with handle 110. In some embodiments, the handle 110 may be substantially composed of wood; metal, such as steel; metal alloy, such as aluminum; or a composite material. Composite materials generally include fibers embedded in a matrix material. The matrix material can be any matrix material known in the art, such as epoxy resin, polyester resin, or any thermoplastic or thermoset polymers. The fibers may be made of any material known in the art for use as composite material fibers, such as carbon, aramids, glass, or metal. Those having ordinary skill in the art will recognize that the handle 110 is not limited to comprising those examples recited here and may comprise any material suitable for striking a ball.

In certain embodiments, the barrel 120 can include a hollow portion 122. In some embodiments, the hollow portion 122 can extend to an opening at one or both ends of the barrel 120. For example, in some embodiments, the hollow portion 122 can extend to an opening at the proximate end 124 of the barrel 120. In some embodiments, the hollow portion 122 can be dimensioned such that it can receive at least a portion of the handle 110. In certain embodiments, the hollow portion can be dimensioned such that it can contain at least a portion of the handle 110 such that a portion of handle 110 (e.g., the lip 114) abuts an interior wall of the barrel 120. In some embodiments, the hollow portion 122 is dimensioned such that it can contain at least a portion of the handle 110 without the barrel 120 contacting the handle (i.e., there is a gap between the handle 110 and the barrel 120). In some embodiments, the barrel 120 can taper, such that the diameter of the barrel at its proximate end 124 is less than the diameter of the barrel 120 at its distal end. In certain embodiments, the barrel may include a notch or groove 126. In some embodiments, the groove 126 may be positioned near the proximate end 124 of the barrel 120. In some embodiments, the barrel 120 may be substantially composed of wood; metal, such as steel; metal alloy, such as aluminum; or a composite material. Composite materials generally include fibers embedded in a matrix material. The matrix material can be any matrix material known in the art, such as epoxy resin, polyester resin, or any thermoplastic or thermoset polymers. The fibers may be made of any material known in the art for use as composite material fibers, such as carbon, aramids, glass, or metal. Those having ordinary skill in the art will recognize that the barrel 120 is not limited to comprising those examples recited here and may comprise any material suitable for striking a ball.

According to some embodiments, the bat 100 can include a first damping section 130 and a second damping section 132. In some embodiments, the first damping section 130 may be configured to dampen vibration occurring at a first flexural bending mode, and the second damping section 132 may be configured to dampen vibration occurring at a second flexural bending mode. In certain embodiments, the first damping section 130 and/or the second damping section 132 can be affixed, attached, or connected at or near the distal end 112 of the handle 110. In some embodiments, the first damping section 130 and/or the second damping section 132 may have a generally cylindrical shape. In some embodiments, the first damping section 130 and/or the second damping section 132 may be dimensioned to substantially complement a portion of the handle 110. In certain embodiments, the diameter of the first damping section 130 and/or the second damping section 132 may gradually increase to complement the diameter and/or shape of the handle 110. In some embodiments, the first damping section 130 and/or the second damping section 132 may be dimensioned such that only a portion of the handle 110 contacts the interior wall of the barrel 120. For example, in some embodiments, the lip 114 of the handle 110 may contact the interior wall of the barrel 120. In certain embodiments, the first damping section 130 and/or the second damping section 132 may be dimensioned such that the first damping section 130 and/or the second damping section 132 prevents the handle 110 from directly contacting the barrel 120 when the bat is at rest. In some embodiments, the first damping section 130 and/or the second damping section 132 may be dimensioned such that the first damping section 130 and/or the second damping section 132 prevents the handle 110 from directly contacting the barrel 120 even when the bat 100 is used to strike a ball.

In some embodiments, the first damping section 130 can comprise a first vibration damping material, and the second damping section 132 can comprise a second vibration damping material. In some embodiments, the first vibration damping material can be different than the second damping material. In certain embodiments, the first vibration damping material may comprise a stiff rubber. In some embodiments, the second vibration damping material may comprise silicone, such as, for example, a silicone rubber-like material. In some embodiments, the first damping section 130 may have a Shore hardness greater than the Shore hardness of the second damping section 132. In some embodiments, the first damping section 130 may have a Shore hardness of approximately 70A to approximately 100A. In certain embodiments, the second damping section 132 may have a Shore hardness of approximately 20A to approximately 40A.

Certain embodiments may include a boundary region 134. In some embodiments, the boundary region 134 may define a boundary between the first damping section 130 and the second damping section 132. According to some embodiments, the boundary region 134 may include a gap (i.e., a space between the first damping section 130 and the second damping section 132 such that the first damping section 130 does not contact the second damping section 132). In some embodiments, the boundary region 134 may include a partial gap (i.e., a portion of an edge of the first damping section 130 contacts or abuts a portion of an adjacent edge of the second damping section 132).

Those of ordinary skill in the art will appreciate that a first damping section 130 and/or second damping section 132 comprising softer materials will provide increased energy loss and a first damping section 130 and/or second damping section 132 comprising a harder material will transmit greater vibration to a user's hands. A first damping section 130 and/or second damping section 132 comprising materials having a relatively medium hardness may provide a compromise, such that less vibration may be transmitted to a user's hands as compared to harder materials while less energy loss may be incurred as compared to softer materials. Certain embodiments may provide greater vibration reduction for a user that typically strikes the ball in a certain area, but some embodiments may do so at the cost of reduced energy transfer between the bat and a batted ball. For example, some embodiments may include a first damping section 130 having a relatively low Shore hardness and a second damping section 134 also having a relatively low Shore hardness, which may provide an increased vibration reduction for a user who tends to strike balls between the sweet spot and the cap, but such embodiments may provide increased vibration reduction at the cost of decreased energy transmission to batted balls. As another example, some embodiments may include a first damping section 130 having a relatively low Shore hardness and a second damping section 132 having a relatively medium Shore hardness, which may provide an increased vibration reduction for a user who tends to strike balls at or near the sweet spot, but such embodiments may provide increased vibration reduction at the cost of decreased energy transmission to batted balls. As yet another example, some embodiments may include a first damping section 130 having a relatively low Shore hardness and a second damping section 132 having a relatively high Shore hardness, which may provide an increased vibration reduction for a user who tends to strike balls between the sweet spot and the handle, but such embodiments may provide increased vibration reduction at the cost of decreased energy transmission to batted balls.

Certain embodiments may provide relatively greater energy transmission to batted balls, but some embodiments may do so at the cost of increased vibration transmitted to a user's hands. For example, some embodiments may include a first damping section 130 having a relatively high Shore hardness, which may provide a relatively increased energy transmission to batted balls for a user who tends to strike balls at or near the sweet spot, but such embodiments may provide increased energy transmission to batted balls at the cost of increased energy transmission to a user's hands. As another example, some embodiments may include a second damping section 132 having a relatively high Shore hardness, which may provide a relatively increased energy transmission to batted balls for a user who tends to strike balls between the sweet spot and the handle or between the sweet spot and the cap, but such embodiments may provide increased energy transmission to batted balls at the cost of increased energy transmission to a user's hands. Some embodiments may include a first damping section 130 having a relatively high Shore hardness and a second damping section 132 having a relatively medium Shore hardness, which may provide a relatively increased energy transmission to batted balls for all users, but such embodiments may provide increased energy transmission to batted balls at the cost of increased energy transmission to a user's hands.

Some embodiments may be configured to compensate for a user's desires regarding energy transmission to batted balls and vibration reduction. Some embodiments may comprise a first damping section 130 having a Shore hardness of approximately 20A to approximately 40A or a Shore hardness of approximately 40A to approximately 70A. Some embodiments may comprise a second damping section 132 having a Shore hardness of approximately 40A to approximately 70A or having a Shore hardness of approximately 70A to approximately 100A. Additional embodiments of the bat 100 may include additional damping sections, such as a third, fourth, fifth and/or sixth damping section.

According to some embodiments, the first damping section 130 can include a protrusion 136. In some embodiments, the second damping section 132 can include the protrusion 136. In some embodiments, the protrusion 136 can be dimensioned to substantially complement the dimension of the groove 126. In some embodiments, the groove 126 and the protrusion 136 may be appropriately dimensioned such that the groove 126 retains the protrusion 136. In some embodiments, the barrel may include a plurality of notches or grooves 126, and the first damping section 130 and/or the second damping section 132 may include a plurality of respective protrusions 136.

Figure 3:
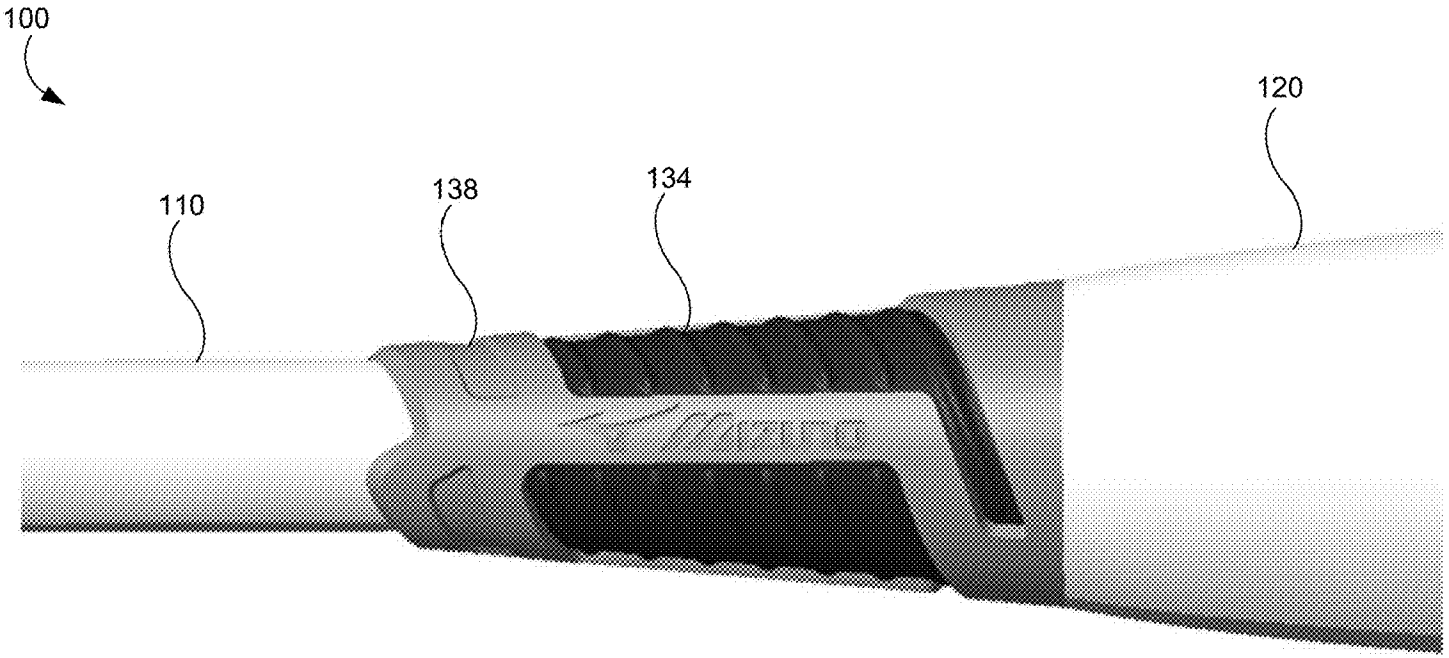
FIG. 3 depicts a partial side view of a vibration damping bat, according to some embodiments of the disclosed technology.

Referring to FIG. 3, certain embodiments may include a damping portion cover 138. In some embodiments, the damping portion cover 138 can cover any portion of the damping portion 130 extending from the hollow portion 122 of the barrel 120. In some embodiments, the damping portion cover 138 may completely cover the portion of the first damping section 130 and/or the second damping section 132 extending from the hollow portion 122 of the barrel 120. In certain embodiments, the damping portion cover 138 may only partially cover a portion of the first damping section 130 and/or the second damping section 132 extending from the hollow portion 122 of the barrel 120, which may enable a user to view the portion of the damping portion 130 extending from the hollow portion 122 of the barrel 120. For example, as shown in FIG. 3, the damping portion cover 138 may partially cover the portion of the second damping section 132 that can extend from the hollow portion 122 of the barrel 120, according to some embodiments.

According to some embodiments, one or more vibration reduction materials of the first damping section 130 and/or the second damping section 132 may be overmolded onto the handle 110. In certain embodiments, the first damping section 130 and/or the second damping section 132 may be assembled or positioned onto the handle 110, and the first damping section 130 and/or the second damping section 132 may then be cured. In some embodiments, the first damping section 130 and/or the second damping section 132 may be adhered to the handle 110 with an adhesive, such as glue or epoxy.

In certain embodiments, a portion of the handle 110 and at least a portion of the first damping section 130 and/or at least a portion of the second damping section 132 may be inserted into the hollow portion 122 of the barrel 120. In some embodiments, at least a portion of the first damping section 130 and/or at least a portion of the second damping section 132 may be inserted into the into the hollow portion 122 of the barrel 120, and the handle 110 may then be inserted into the barrel 120 and the first damping section 130 and/or the second damping section 132.

In some embodiments, the first damping section 130 and/or the second damping section 132 may be adhered to the barrel 120 with an adhesive, such as glue or epoxy. In certain embodiments, the first damping section 130 and/or the second damping section 132 may be positioned on the handle 110, a portion of the handle 110 and at least a portion of the first damping section 130 and/or at least a portion of the second damping section 132 may be inserted into the hollow portion 122 of the barrel, and the first damping section 130 and/or the second damping section 132 may then be cured.

In some embodiments, the first damping section 130 and/or the second damping section 132 may be injection molded. For example, in some embodiments, the handle 110 and the barrel may be assembled together with the first damping section 130, and the damping portion cover 138 may be attached to the handle 110 and/or barrel 120. Subsequently, the second damping section 132 may be injection molded into the interface of the damping portion cover 138, the handle 110, and/or the barrel 120. As another example, in some embodiments, the handle 110 and the barrel may be assembled together without any vibration reduction materials, and the damping portion cover 138 may be attached to the handle 110 and/or the barrel 120. Subsequently, the first damping section 130 may be injection molded into the interface of the damping portion cover 138, the handle 110, and/or the barrel 120 after which time the second damping section 132 may be likewise injection molded.

While several possible embodiments are disclosed above, embodiments of the present invention are not so limited. For instance, while several possible configurations have been disclosed (e.g., a bat with a shock-absorbing or vibration damping portion), other suitable materials and configurations could be selected without departing from the spirit of embodiments of the invention. In addition, the location and configuration used for various features of embodiments of the present invention can be varied according to a particular bat size and weight, a particular set of rules, or simply user preference. Such changes are intended to be embraced within the scope of the invention.

The specific configurations, choice of materials, and the size and shape of various elements can be varied according to particular design specifications or constraints requiring a device, system, or method constructed according to the principles of the invention. For example, while certain exemplary ranges have been provided for thicknesses and locations, other configurations could be used for different sized bats or bats for different sports. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. A bat comprising:

a handle having a proximate end and a distal end;

a barrel having a hollow portion;

a first damping section comprising a first material, the first damping section being at least partially interposed between, and in contact with, a portion of the handle and a portion of an inner wall of the barrel; and a second damping section comprising a second material, the second damping section being at least partially interposed between, and in contact with, a portion of the handle and a portion of the inner wall of the barrel, wherein the first damping section is located nearer the distal end of the handle than the proximate end of the handle and the second damping section is located nearer the proximate end of the handle than the first damping section, and wherein at least a portion of the first damping section or at least a portion of the second damping section prevents the handle from directly contacting the barrel when the bat is at rest.

2. The bat of claim 1, wherein the first material has a Shore hardness that is greater than a Shore hardness of the second material.

3. The bat of claim 2, wherein the first material has a Shore hardness of approximately 70A to approximately 100A.

4. The bat of claim 2, wherein the first material comprises rubber.

5. The bat of claim 2, wherein the second material has a Shore hardness of approximately 20A to approximately 40A.

6. The bat of claim 2, wherein the second material comprises silicone.

7. The bat of claim 1 further comprising a boundary region between a proximate edge of the first damping section and a distal edge of the second damping section.

8. The bat of claim 7, wherein the boundary region comprises a gap.

9. The bat of claim 1, wherein at least a portion of the first damping section and at least a portion of the second damping section is attached to the barrel with an adhesive.

10. The bat of claim 1, wherein the first damping section comprises a protrusion, and wherein the barrel comprises a groove in the inner wall, the groove configured to receive at least a portion the protrusion.

11. The bat of claim 10, wherein the protrusion is located about a circumference of an outer surface of the first damping section and the groove is located about a circumference of the inner wall of the barrel.

12. The bat of claim 10, wherein protrusion is a first protrusion and the groove is a first groove, wherein the barrel comprises a second groove in the inner wall, and wherein the second damping section comprises a second protrusion, the second groove configured to receive at least a portion of the second protrusion.

13. The bat of claim 12, wherein the second protrusion is located about a circumference of an outer surface of the second damping section and the second groove is located about a circumference of the inner wall of the barrel.

14. The bat of claim 1, wherein the first damping section is located substantially within the barrel, and wherein a portion of second damping section is located within the barrel and a portion of the second damping section extends out of the barrel.

15. The bat of claim 1, wherein the handle includes a lip that extends radially outward, the lip having a bottom surface, and wherein a portion of the first damping section abuts the bottom surface.

16. The bat of claim 1, wherein the handle comprises a composite material and the barrel comprises metal.

17. A bat comprising:

a handle having a proximate end and a distal end;

a barrel having a hollow portion and an inner wall, the inner wall comprising a groove ring traversing a circumference of the inner wall of the barrel;

a first damping section comprising rubber having a Shore hardness of approximately 70A to approximately 100A and comprising a protrusion ring traversing a circumference of an outer surface of the first damping section, wherein the first damping section is interposed between a portion of the handle and a portion of the inner wall of the barrel and at least a portion of the protrusion ring is inserted into at least a portion of the groove ring;

a second damping section comprising silicone having a Shore hardness of approximately 20A to approximately 40A, the second damping section having a first portion interposed between a portion of the handle and a portion of the inner wall of the barrel and a second portion extending out of the hollow portion of the barrel; and a gap between a proximate edge of the first damping section and a distal edge of the second damping section, wherein at least a portion of the first damping section or at least a portion of the second damping section prevents the handle from directly contacting the barrel when the bat is at rest.

18. A method of manufacturing a bat, the method comprising:

providing a handle having a proximate end and a distal end;

providing a barrel having a hollow portion and an inner wall;

providing a first damping section comprising a first material;

attaching the first damping section to the handle nearer the distal end of the handle than the proximate end of the handle;

providing a second damping section comprising a second material;

attaching the second damping section to the handle nearer a proximate end of the handle than the first damping section; and inserting the handle, the first damping section, and at least a portion of the second damping section into the hollow portion of a barrel such that (i) the first damping section is at least partially interposed between, and in contact with, a portion of the handle and a portion of the inner wall of the barrel and (ii) the second damping section is at least partially interposed between, and in contact with, a portion of the handle and a portion of the inner wall of the wall, and such that at least a portion of the first damping section or at least a portion of the second damping section prevents the handle from directly contacting the barrel.

19. The method of claim 18, wherein attaching the first damping section to the handle comprises overmolding the first damping section onto the handle.

20. The method of claim 18, wherein attaching the first damping section to the handle comprises positioning the first damping section on the handle and adhering the first damping section to the handle via curing.

* * * * *